US005772542A

United States Patent [19]

Gildea et al.

[11] Patent Number: 5,772,542

[45] Date of Patent: Jun. 30, 1998

[54] TETHER FOR A BALL

[75] Inventors: Larry A. Gildea, Gobles; Gregg R. Beaudette, St. Joseph, both of Mich.

[73] Assignee: All Sports Training Resources, Inc., St. Joseph, Mich.

[21] Appl. No.: 795,136

[22] Filed: Feb. 7, 1997

[51] Int. Cl.[6] ..... A63B 69/00

[52] U.S. Cl. ..... 473/576

[58] Field of Search ..... 473/422, 423, 473/424, 425, 426, 213, 576, 108, 109, 435; 43/55; 273/DIG. 30

[56] References Cited

U.S. PATENT DOCUMENTS

| | | | |
|---|---|---|---|
| 289,221 | 11/1883 | Clark . | |
| 1,655,599 | 1/1928 | Dolan | 473/423 |
| 1,708,796 | 4/1929 | Lawrence | 473/423 |
| 3,042,404 | 7/1962 | Masters | 473/424 |
| 3,227,450 | 1/1966 | Pruitt | 473/426 |
| 3,525,523 | 8/1970 | Bellagamba . | |
| 3,709,491 | 1/1973 | Minchin . | |
| 3,790,171 | 2/1974 | Anderson . | |
| 3,804,409 | 4/1974 | Schachner | 473/426 |
| 3,830,504 | 8/1974 | Koo . | |
| 3,893,669 | 7/1975 | Myers | 273/DIG. 30 |
| 3,940,133 | 2/1976 | Civita | 473/424 |
| 4,095,787 | 6/1978 | Saferstein | 473/423 |
| 4,174,107 | 11/1979 | Hickey | 473/423 |
| 4,235,042 | 11/1980 | Hills . | |
| 4,240,592 | 12/1980 | Russo . | |
| 4,350,338 | 9/1982 | May | 473/423 |
| 4,352,497 | 10/1982 | Warehime . | |
| 4,890,413 | 1/1990 | Nelson | 43/55 |
| 4,927,145 | 5/1990 | Davis . | |
| 4,964,634 | 10/1990 | Boyer | 473/423 |
| 4,991,840 | 2/1991 | Patton . | |
| 5,031,910 | 7/1991 | Kopp . | |
| 5,058,883 | 10/1991 | Dybvik . | |
| 5,193,802 | 3/1993 | Saltus . | |
| 5,228,690 | 7/1993 | Rudell | 273/DIG. 30 |

FOREIGN PATENT DOCUMENTS

| | | | |
|---|---|---|---|
| 688151 | 9/1950 | United Kingdom | 473/213 |

*Primary Examiner*—Theatrice Brown
*Attorney, Agent, or Firm*—Fitch, Even, Tabin & Flannery

[57] ABSTRACT

A tether for a ball; the tether formed from a primary shock cord having a first spring constant and a secondary shock device having a second spring constant. The primary shock cord and differential shock devices may be connected together by way of a swivel in order to enable natural movements of the ball. In order to reduce the possibility of failure of the tether, the different spring constants selected for the primary shock devices and the differential shock device.

19 Claims, 6 Drawing Sheets

TETHER FOR A BALL

BACKGROUND OF THE INVENTION

1. Field of the Invention

The present invention relates to a tether for a ball, and more particularly to a tether for a ball in which the tether is formed with a non-linear spring constant, for example, from a plurality of elastic shock devices having different spring constants, selected to prevent failure as a result of relatively large impact forces to the ball.

2. Description of the Prior Art

Various tethered ball arrangements are known in the art. Such tethered ball arrangements are normally used for footballs, soccer balls, and the like. Examples of such tethered ball and object arrangements are disclosed in U.S. Pat. Nos. 289,221; 3,790,171; 3,709,491; 4,235,042; 4,240,592; 4,352,497 and 5,058,883. Tethered footballs are also known which enable a person to practice various football skills, such as kicking, punting, passing and field goal kicking in which the ball is automatically returned to the person engaging in the practice. Examples of such systems are disclosed in U.S. Pat. Nos. 3,227,450; 3,525,523; 3,804,409; 4,350,338; 4,991,840; 5,031,910.

U.S. Pat. No. 3,227,450 as well as U.S. Pat. No. 4,991,840 relate to a tethered football for practicing kicking. The footballs disclosed in these patents are secured to shock cords, which, in turn, are anchored to the ground. Such an arrangement is useful in practicing field goal kicking. U.S. Pat. No. 3,525,523 is another example of a tethered football for use in practicing kicking. In this arrangement, a shock cord or tether is connected between two spaced apart ground stakes. A second shock cord is then used to connect the football to the first shock cord. Unfortunately, such an arrangement has rather limited use and is not useful for practicing other football skills, such as passing.

U.S. Pat. Nos. 3,804,409; 4,350,338; 4,350,338 and 5,031,910 disclose tethered footballs, suitable for use for practicing various football skills including kicking and passing. The '409 and '338 patent disclose tethers formed from a elastic shock cord serially connected to a non-elastic cord, connected on one end to a football, while the other end is connected to a stationary object, such as a stake. The '910 patent discloses another tethered football in which the tether is formed from a single elastic shock cord.

Unfortunately, the shock cord in such tethered footballs is subject to failures when the footballs are subjected to relatively powerful impact forces during kicking practice. During such a condition, the force or power of the kick has been known to exceed the strength of the elastic shock cord causing the shock cord to fail.

SUMMARY OF THE INVENTION

It is an object of the present invention to solve various problems in the prior art.

It is yet another object of the present invention to provide a tether for a ball, suitable for various practice skills.

It is yet another object of the present invention to provide a tethered ball in which the tether is formed from a shock cord arrangement that is relatively less susceptible to failure than known tethers.

Briefly, the present invention relates to a tether for a ball, such as a football, in which the tether is formed with a non-linear spring constant, for example, from a plurality of serially connected elastic shock cords having different spring constants. The shock cords may be connected together with a swivel in order to enable spinning or spiraling movement of the ball.

DESCRIPTION OF THE DRAWINGS

These and other objects of the present invention will become readily understood with reference to the following specification and attached drawings wherein.

DETAILED DESCRIPTION

Figure 1:
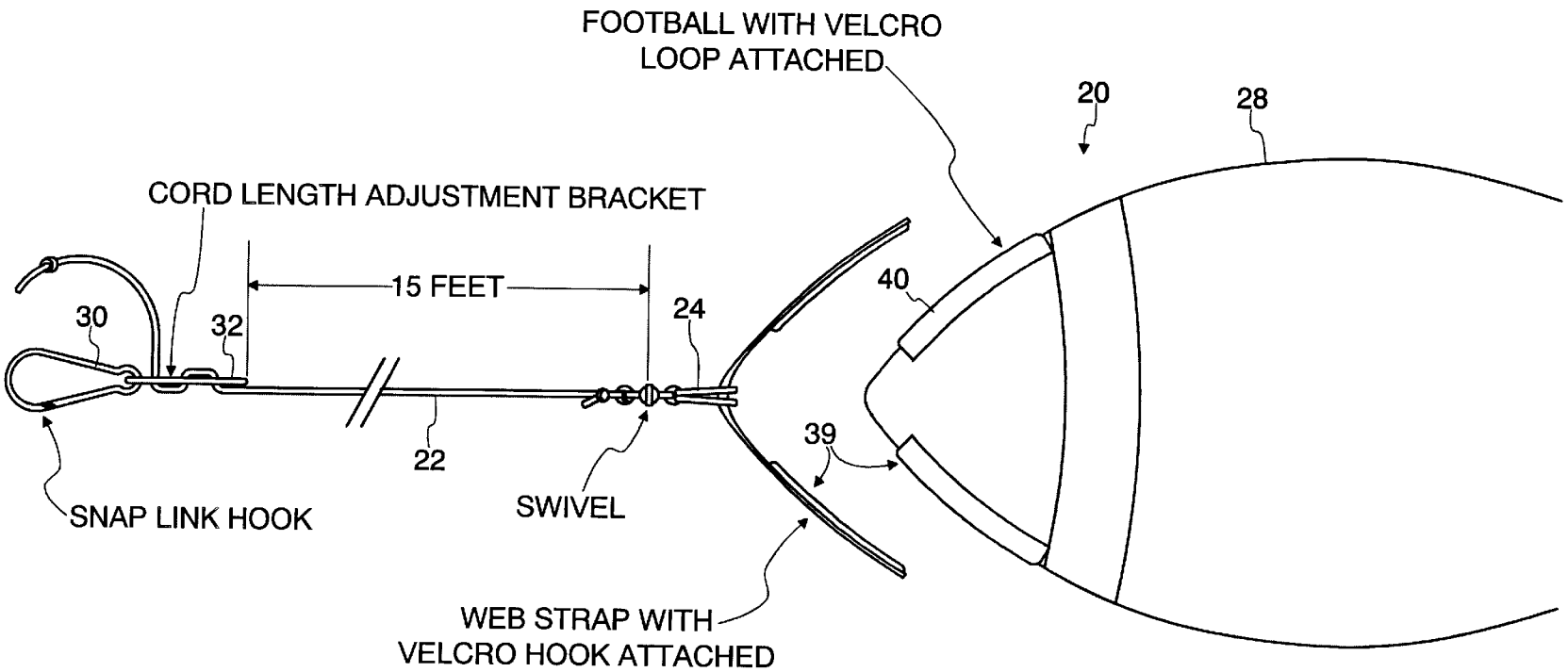
FIG. 1 is a perspective view of the tethered ball illustrated for example, such as football in accordance with the present invention illustrating one method for attaching the tether to the ball.

The tether for the ball in accordance with the present invention is illustrated in FIG. 1 and generally identified with the reference numeral 20. The invention is described and illustrated with reference to a tethered football. However, the principles of the invention are applicable to the other types of balls, such as soccer balls, tether balls and the like as well as tethered objects, such as badminton birdies and the like. The tether 20 is formed with a non-linear spring constant and may include a primary shock cord 22 and a differential shock device 24, which may be coupled together by way of a swivel 26. Various alternate embodiments of the invention are illustrated in FIGS. 1–7 for attaching the tether 20 to a ball 28. One free end of the primary shock cord 22 may be attached to a snap link hook 30 to enable the tether 20 to be secured to a stationary object, such as a ground stake (not shown). A cord length adjustment bracket 32 may be used as shown in FIG. 1 to enable the length of the primary shock cord 22 to be adjusted.

An important aspect of the invention is that the tether 20 is formed with a non-linear spring constant. In particular the tether 20 may be formed from a primary shock cord 22 having a predetermined spring constant connected to a differential shock device 24 having a different spring constant, which together provide a non-linear spring constant. The spring force of the differential shock device 24 may be selected so that the differential shock device 34 does not begin to extend until the primary shock cord 12 is fully extended and stretched out to a point well below its failure point.

Figure 8:
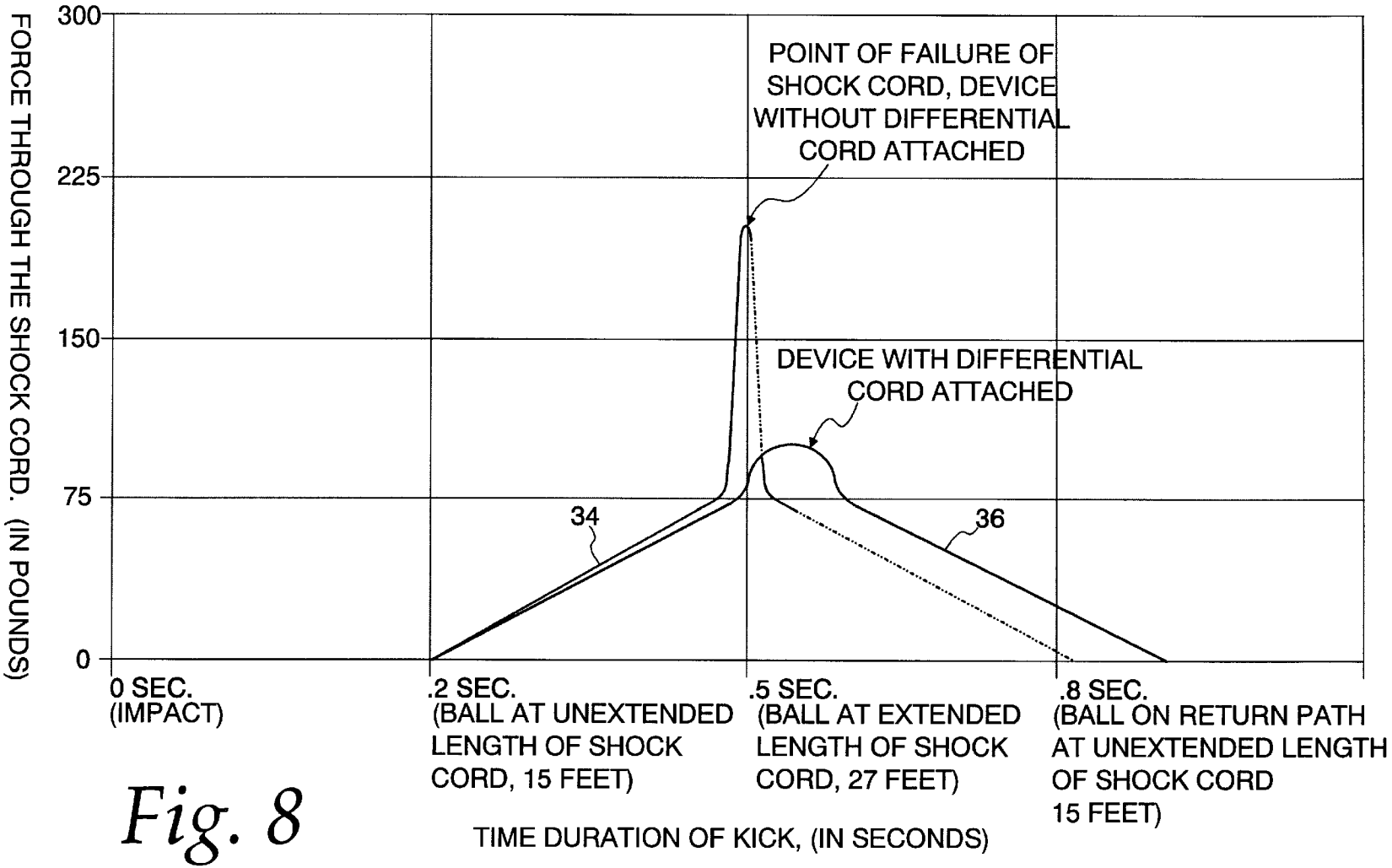
FIG. 8 is a graphical illustration illustrating the force through the shock cord as a function of the force on the ball in terms of the time duration of the kick for both a single shock cord as well as a shock cord arrangement in accordance with the present invention.

As illustrated in FIG. 8, the use of non-linear spring constant formed, for example, from different spring constants for the primary shock 22 and differential shock device 24 reduces the risk of failure of the primary shock cord 22. In particular, referring the FIG. 8, the force through the primary shock cord 22 is graphically illustrated as a function of the time duration of the kick which, in turn, is proportional to the force placed on the ball 28. The graph 34 illustrates the force on the primary shock cord 22 when the ball 28 is kicked with a force to cause failure whereas the graph 36 illustrates the response of the primary shock cord in response to the same force on the football 28 when a differential shock device 24 in accordance with the present invention is used.

Referring first to the graph 34, and assuming that the primary shock cord 22 is 15 feet in length with a spring constant of 0.4 pounds per inch, at approximately 0.2 seconds after impact, the momentum of the ball 28 causes the primary shock cord 22 extend to its nominal length of about 15 feet. Between 0.2 seconds and about 0.5 seconds, the primary shock cord 22 stretches to its point of failure. which, as illustrated in FIG. 8, is about 200 pounds.

The graph 36 illustrates the response of the primary shock cord when subjected to the same force when the tether 20 in accordance with the present invention is used which includes a primary shock cord 22 and a serially connected differential shock device 24. In this situation, at about 0.2 seconds, the momentum of the ball 28 causes the primary shock cord 22 to extend to its nominal length of about 15 feet. Between at about 0.2 seconds and 0.5 seconds, the primary shock cord 22 stretches, causing the force on the primary shock cord 22 to ramp up towards 75 pounds. However, instead of failing as the case of the condition illustrated by graph 34, the differential shock device 24 is used to limit the force on the primary shock cord 22 to about 100 pounds, which, as shown in FIG. 8, is well below the failure point for the primary shock cord 22. As shown in FIG. 8, after reaching its maximum extension for the impact force, the ball 28 begins its return path in which the force on the primary shock cord decreases until the primary shock cord 22 returns to its nominal length at a little over 0.8 seconds. Thus, for a given impact, the differential shock device 24 not only prevents failure but significantly reduces the forces on the primary shock cord 22 which otherwise would have failed.

The ball 28 for use with the tether 20 may be a regulation size and weight American-type football from a tactile butyl rubber with an inflatable rubber bladder and internal winding. As mentioned above, the principles of the present invention are also applicable to other balls as well as including non-regulation size and weight footballs. Essentially, the principles of the present invention are adapted to be used with virtually any type of ball, such as a soccer ball as well as objects, such as badminton birdies.

The primary shock cord 22 may be formed from an elastic cord, for example, having a diameter of 0.125 inches with a spring constant of, for example, 0.4 pounds per inch. The primary shock cord 22 may be formed from a length of about 15 feet of an elastic cord with single overhand knot loops at 5, 10 and 15 foot intervals which enable the length of the primary shock cord 22 to be adjusted by attaching the various knot loops to the snap link hook 30. The primary shock cord 22 may be formed from a rubber inner rope consisting of 40 strands of 0.018 inch diameter of high quality latex rubber for a consistent spring constant and long life. A nylon casing may be provided to provide over the strands strength and impact resistance at extended length. Preferably, the maximum extension of the primary shock cord 22 is the range of 180% to 225% of its length. A suitable shock cord is available from John Howard Company under Part No. 2400.

A swivel 26 may be used to join the primary shock cord 22 and differential shock device 24 to enable natural motion of the football 28 (or other balls) such as spiralling passes and punts. The swivel 26 may be formed from a stainless steel ball encased in a brass nickel plated body and include a spindle for rotatable carrying pair of rotatable rings 34 and 36, for example, formed from stainless steel. The swivel 26 preferably is selected to withstand about 125 pounds of shock and formed from a non-corrosive material. A suitable swivel 26 is available as Model W3R from Sampo Corporation.

Figure 2:
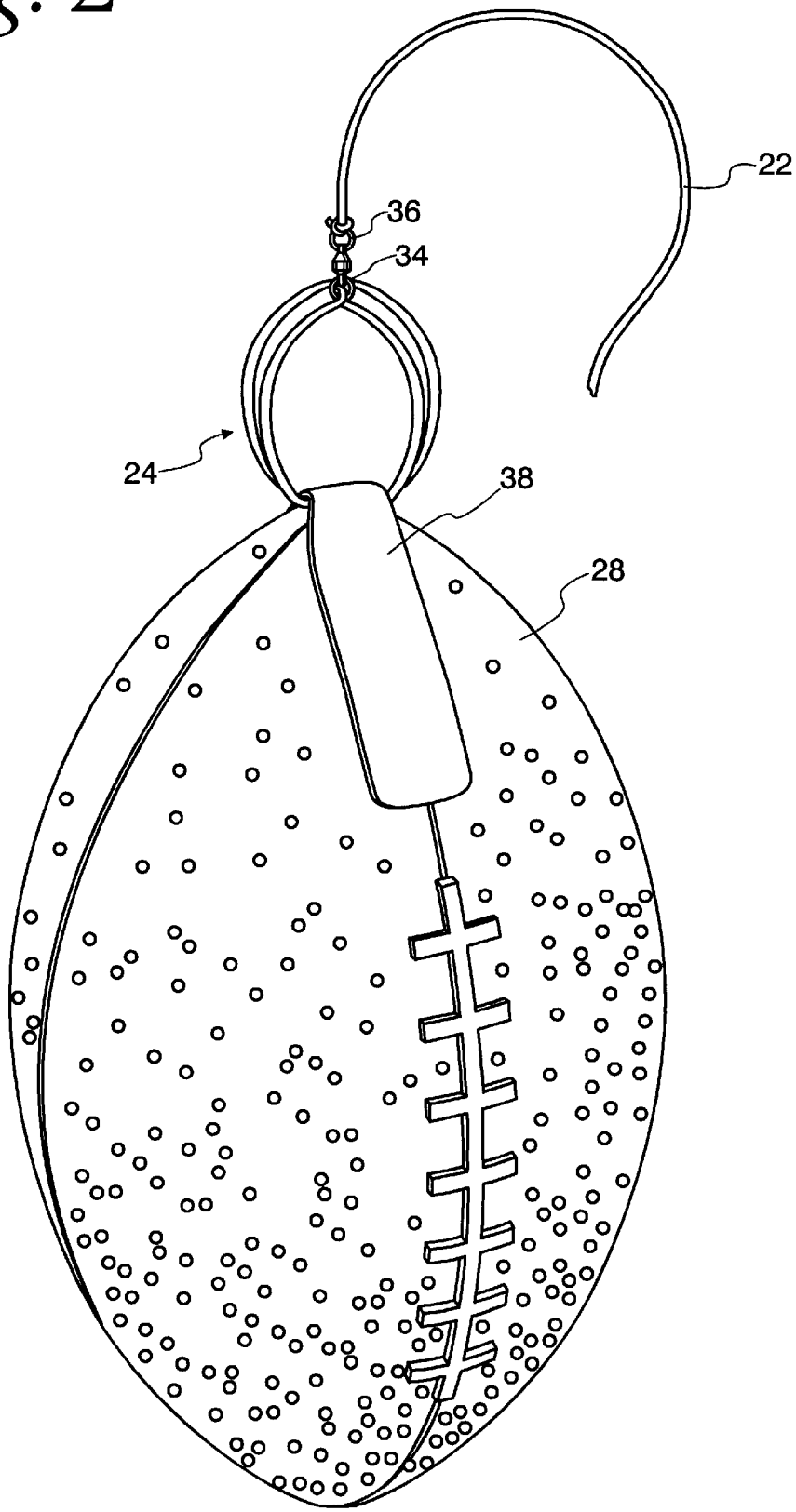
FIGS. 2–7 illustrate alternate methods for attaching the tether to a ball.
Figure 9:
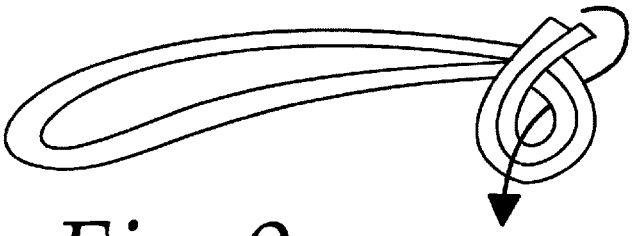
FIGS. 9 and 10 illustrate the method for forming a differential shock cord in accordance with the present invention.
Figure 10:
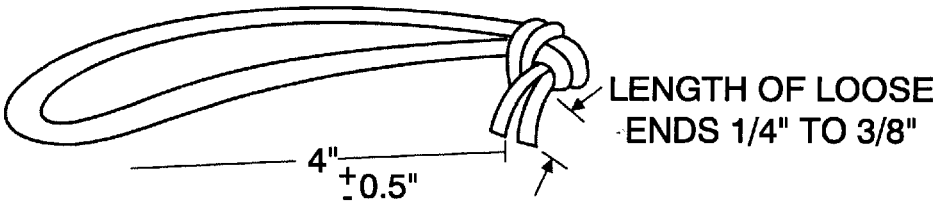

There are various embodiments of the differential shock device 24, all within the broad scope of the invention. For example, FIGS. 1 and 2 illustrate the use of a cord for use as the differential shock device 24. The cord may be a 12 inch length of cord, for example, of the same material used for the primary shock cord 22, as discussed above. In this embodiment, the differential shock device 24 is formed as a double loop. In order to form the double loop, the free ends of the 12 inch cord are placed side by side and tied in a knot, for example, an overhand knot, such that ¼ to ⅜ inches extends beyond the knot as generally shown in FIGS. 9 and 10. Such an arrangement will form two loops approximately 3 inches in diameter. The free ends of the loop may be hot knifed or melted with an open flame to prevent fraying.

Figure 11:
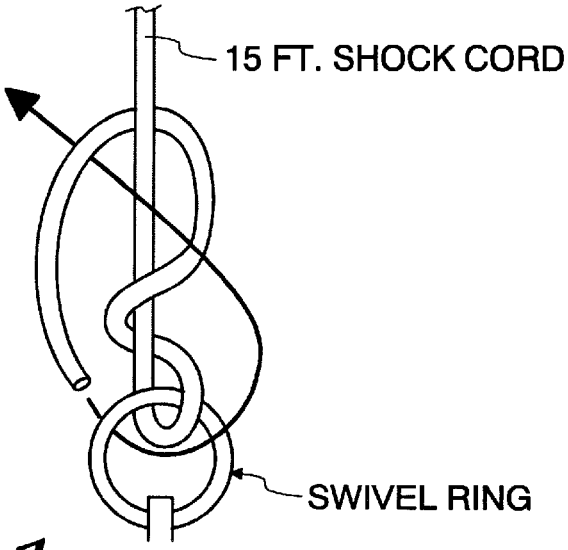
FIG. 11 illustrates the method for attaching the primary shock cord to the swivel.

The principles of the present invention apply to embodiments with and without a swivel 26. If a swivel 26 is not used, the primary shock cord 22 is secured to the differential shock device 24 by various conventional methods. If a swivel 26 is used, the double loop is fed through one of the rotatable rings 34, 36 on the swivel 26 as discussed below. The double loop is pulled such that the knot is positioned away from the rotatable ring 34, 36. The primary shock cord 22 is connected to the other rotatable ring 34, 36 on the swivel 26 as generally shown in FIG. 11. In particular, the primary shock cord 22 is fed through the rotatable ring 34, 36 on the swivel 26 and tied in a knot, for example, a fisherman's knot as shown in FIG. 11. As shown in FIG. 1, the snap hook link 30 may be attached to one end of the primary shock cord 22 or to one of attachment loops formed in the primary shock cord 22 as discussed above to enable the tethered ball 28 to be connected to a stationary object, such as a ground stake. The snap link hook 30 is preferable zinc plated to resist corrosion. Such snap link hooks 30 are commonly available.

Various options are contemplated for attaching the serially coupled primary shock cord 22 and the differential shock device 24 to the ball 28. These embodiments are shown in FIGS. 1–7. Referring first to FIGS. 1–2, a web strap 38 may be used and fed through the double loops of the differential shock device 24 formed from the double loop as discussed above. The web strap 38 may be formed from a nylon material about 1 inch wide and about 6 inches long with a thickness of about 0.04 inches. The cut ends of the web strap 38 may be chamfered on each corner melted with hot iron or open flame to prevent fraying.

In the embodiment illustrated in FIG. 1, the web strap 38 may be attached to the ball 28 by way of a velcro fastening strips 39. In particular, two velcro strips 39 may be attached to the ball 28 as generally shown in FIG. 1 with an adhesive, such as cyanoacrylate glue, for example, type 232 Aron Alpha industrial glue from Borden, Inc. Similarly, two velcro strips 39 may be attached to the web strap 38 with an adhesive above to form a tether system for the ball 28 which allow the ball 28 to be used separately from the tether 20 as generally shown in FIG. 1.

FIG. 2 illustrates an alternate embodiment in which the web strap 38 is attached directly to the ball 28. In this embodiment, an adhesive, for example, as mentioned above, is applied to web strap 38 or the ball 28 to enable the web strap 38 to be rigidly secured to the ball 28. In the embodiments illustrated in FIGS. 1 and 2, the knot formed from the double loop used to form the differential shock device 24 is secured beneath the web strap 38.

Figure 3:
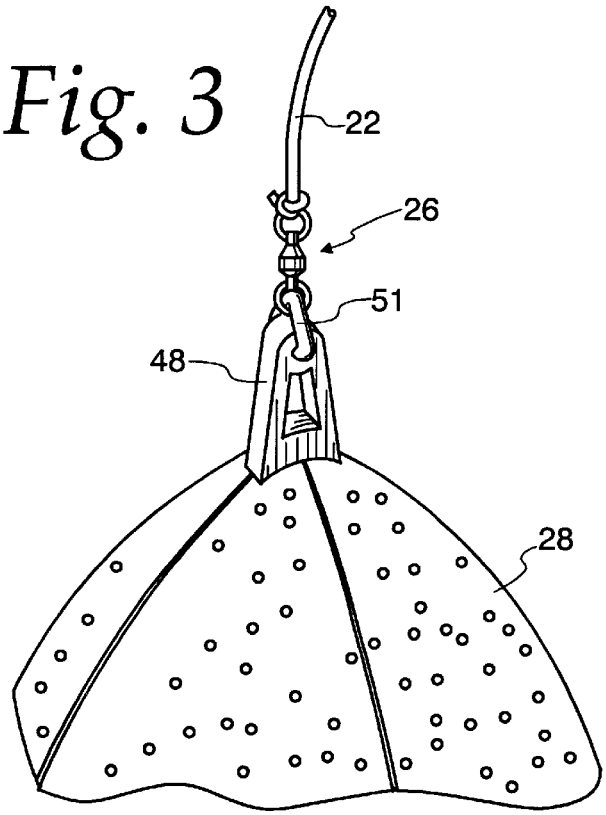
Figure 4:
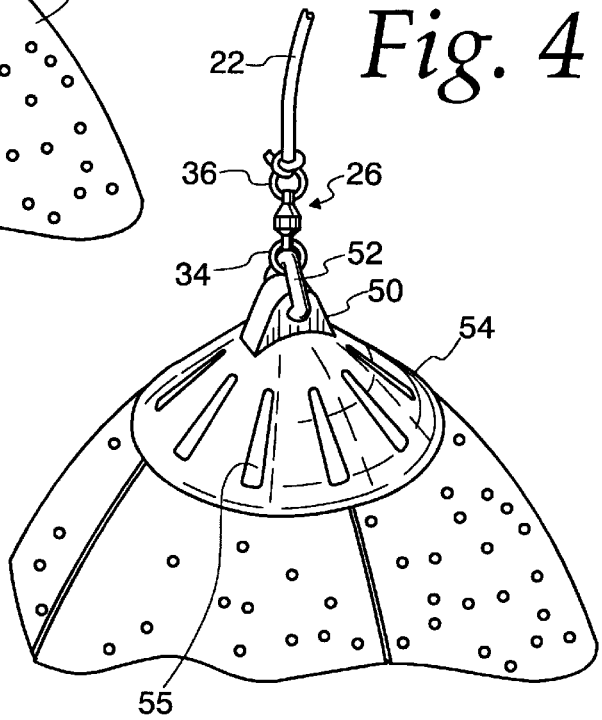

FIGS. 3 and 4 illustrate an embodiment in which an extending tab 48, 50 is used to form the differential shock device 24. The tabs 48,50 are formed from an elastomer material, such as latex rubber, having a different spring constant than the primary shock cord 22. Each of the tabs 48, 50 is provided with apertures (not shown) to enable the tabs 48, 50 to be coupled to one of the rotatable rings 34, 36 on the swivel 26 by way of a small clip 51, 52, which may be formed with a split ring configuration which can be split and crimped back together to enable the tabs 51, 52 to be coupled to one of the rotatable rings 34, 36 on the swivel 26.

In the embodiment illustrated in FIG. 3, the extending tab 48 may be integrally molded or otherwise securely attached to the ball 28 as shown. In FIG. 4, the extending tab 50 may be formed as part of a cap 54, formed with the same curvature as the ball 28. The cap 54 is adapted to be rigidly secured to the ball 28 with an adhesive around the perimeter of the cap 54. The slots 55 formed in the cap 54 may be used to create or adjust the spring constant of the cap 54.

Figure 5:
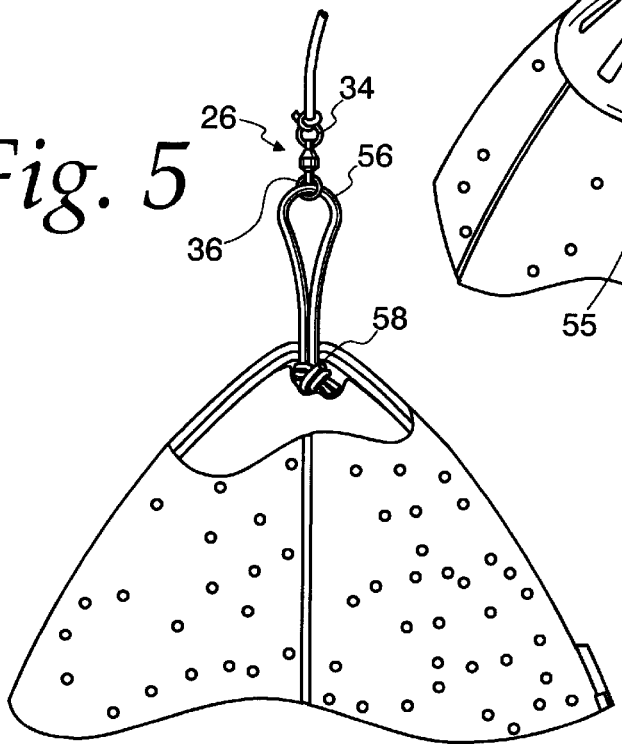

FIG. 5 illustrates an embodiment in which the ball 28 is provided with an extending loop 56, having a relatively higher spring constant than the primary shock cord 22. In this embodiment, the extending loop 56 acts as the differential shock device 24. The double loop 56 provides a higher spring constant greater than the primary shock cord 22. This embodiment is contemplated for use with a ball, such as a football, which includes an internal bladder. In such an embodiment, an aperture may be formed in one end of the football 28. The double loop 56 may be formed from a length of the material used to form the primary shock cord 22. Once the loop 56 is formed, the ends may be tied in knot 58 as shown to prevent the loop 58 from being pulled through the aperture. The loop 56 is then coupled to the primary shock cord 22. In an embodiment in which a swivel 26, a portion of the cord forming the loop 56, is fed through one of the rotatable rings 34,36 on the swivel 26. The loop 56 is then tied in a knot 58 as shown in FIG. 5.

Figure 6:
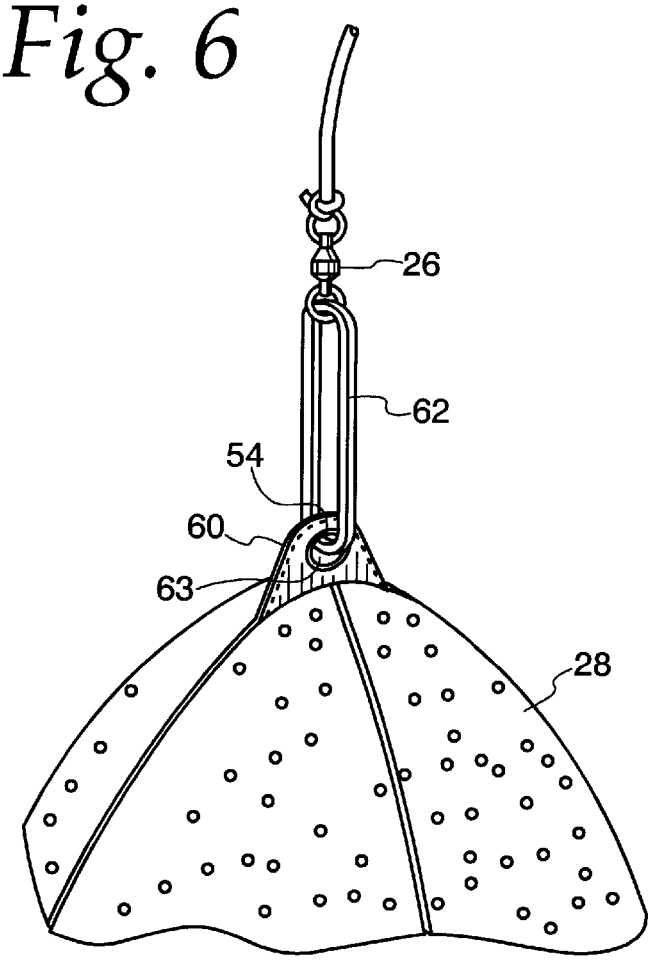

FIG. 6 illustrates an embodiment in which an extending tab 60 is rigidly secured to the ball 28, for example, by integral molding or sewing the tab 60 with respect to the ball 28. The tab 60 may be formed from an inelastic material with an aperture 63. The differential shock device 24 in this embodiment may be formed from a length of elastic material 62, such as the material used to form the primary shock cord 22 discussed above. The length of the elastic material 62 is fed through the aperture 63 in the extending tab 60 as well as one of the rotatable rings 34, 36 on the swivel 26. The ends of elastic material 62 are fastened together to form a continuous loop as shown. In particular, a barrel connector (not shown) may be used. The free ends of the elastic material are inserted into the barrel connector. The barrel connector is then crimped at each end to secure the ends to the connector. The loop 62 will have a spring constant that is greater than the spring constant of the primary shock cord 22.

Figure 7:
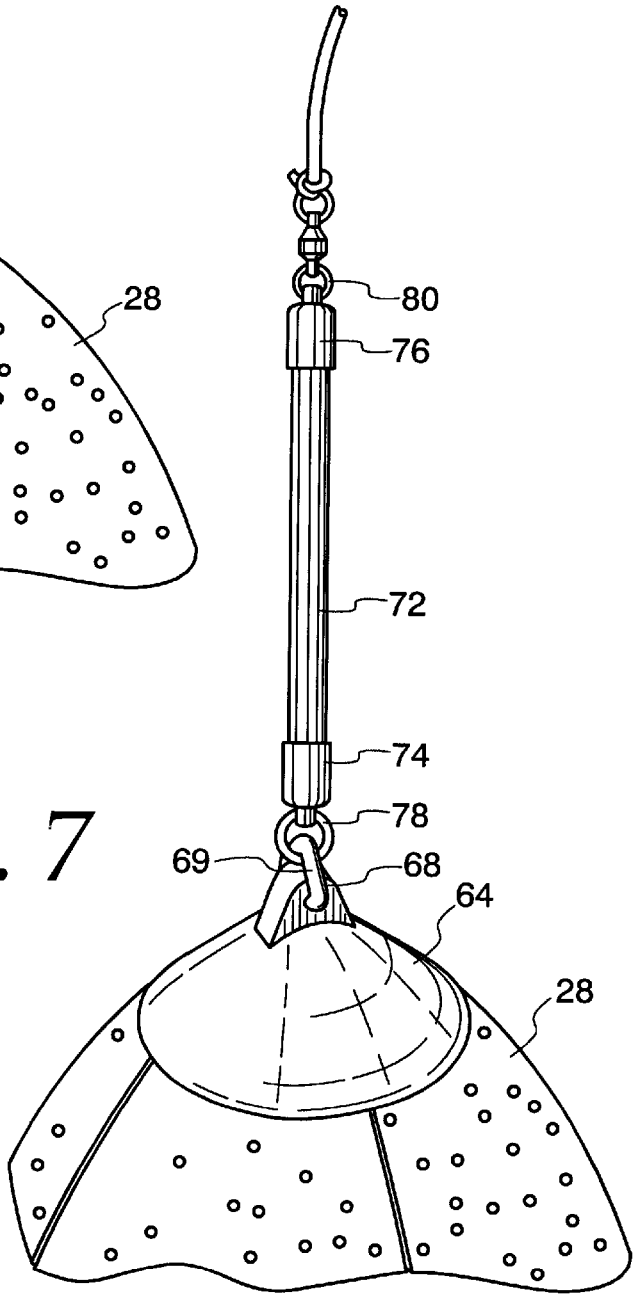

FIG. 7 illustrates yet another alternate embodiment in which a cap 64 is formed with an extending tab 68. The cap 64 is formed with the same curvature as the ball 28 and may be rigidly secured to the ball 28 with an adhesive as discussed above. Alternatively, the perimeter of the cap 64 may secured to the ball 28 as discussed above.

The differential shock device 24 in this embodiment may be formed from an elastic material 72 having a spring constant relatively greater than the spring constant of the primary shock cord 22. A pair of end caps 74 and 76 are provided. The end caps 74, 76 may be hollow cylindrical shaped devices adapted to be crimped after the elastic material 72 is inserted therewithin. The end caps 74 and 76 may be provided with rings 78 and 80, rigidly secured to the end caps 74, 70. A clip 69, for example a metal clip, formed as a split ring which can be separated and crimped back together to enable the clip 69 to be secured to one of the rings 78,80 as well as the extending tab 68.

In order to make the tethered football 28, for example, as illustrated in FIG. 2, the differential shock cord 24 is formed from an elastic cord like material approximately 12 inches long. The free ends of the cord are brought together. A square knot or double overhand knot is tied at the free ends of the cord to form a loop about 3 inches in diameter with about ¼ or ½ inches extending from the end of the cord. As mentioned above, the free ends may be either hot knifed or melted with an open flame to prevent fraying. Once the differential shock cord 24 is formed, the web strap 38 may be cut from an one inch strip of nylon web approximately 6 inches long. The ends of the web strap 38 may be chamfered or cut in a semicircular pattern to prevent the web strap 38 from peeling away from the ball 28 after extensive use. The cut ends of the web strap 38 are melted with a hot iron or open flame to prevent fraying or unraveling of the web strap. After the web strap 38 is made, the double loop forming the differential shock cord 24 is attached to the swivel 26. In particular, the double loop is fed through one of the rings 34 or 36 on the swivel 26 such that the square knot is positioned to be hidden between the web strap 38 and the football 28. Next, the web strap 38 is attached to the football 28 or web strap 38 with an adhesive as discussed above. Enough glue is applied to the football 28 or web strap 38 to saturate a 1 inch by ½ inch area on each end but enough to cause the glue to seep through the webbing or edges. The web strap 38 is then secured to the football 28. Pressure may be applied to the web strap for approximately 30 seconds to allow the glue to sufficiently cover the webbing and the texture of the football 28. After the web strap 38 is secured of the football 28, the free end of the web strap 38 is fed through the double loop, after which, the free end of the web strap 38 is secured to the football 28. The square knot of the double loop may be positioned to be hidden between the football 28 and the web strap 38.

The primary shock cord 22 may be formed from a piece of elastic cord having a predetermined spring constant as discussed above approximately 16 foot long. At approximately 5 foot lengths, a piece of the cord is double up and tied with a single overhand knot to form attachment loops as discussed above. The same operation is repeated at the 10 foot length and at the end of the cord to provide for adjustable shock cord lengths. The attached loops may be attached to the snap link hook 30 or to a stationary objects. After the primary shock cord 22 is formed, it may be attached to the swivel 26 by feeding it through the swivel 26 and tying two overhand knots forming a slip knot as generally shown in FIG. 12. The ends may be melted to prevent fraying.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

We claim:

1. A tether for a ball the tether comprising:

a primary shock cord having two free ends and a first spring constant;

one of said two free ends adapted to be secured to stationary object; and a differential shock device selected to have a relatively higher sprint constant than said first spring constant, said differential shock device adapted to be secured to the other of said two free ends of said primary shock cord and attached to a ball by attaching means;

wherein said spring constant of said differential shock device is selected to permit said differential shock device to begin stretching once said primary shock cord has stretched beyond its original length to a slightly below failure of said shock cord point.

2. The tether as recited in claim 1, further including a cord length adjustment bracket for enabling the length of the primary shock cord to be adjusted.

3. The tether as recited in claim 2, further including a snap link hook, rigidly secured to said cord length adjustment bracket.

4. The tether as recited in claim 1, wherein said differential shock device at least one loop of the material used for said primary shock cord.

5. The tether as recited in claim 1, wherein said attaching means includes a strap, adapted to be threaded through said at least one loop.

6. The tether as recited in claim 5, wherein said attaching means includes means for enabling said attaching means to be releasably attached to a ball.

7. The tether as recited in claim 6, wherein said enabling means includes a plurality of velcro strips.

8. The tether as recited in claim 1, further including a swivel with a pair of rotatable rings for enabling said primary shock cord and said differential shock device to be secured thereto.

9. The tether as recited in claim 1, wherein said ball is a regulation size football.

10. The tether as recited in claim 1, wherein said ball is a junior size football.

11. The tether as recited in claim 1, wherein said ball is a soccer ball.

12. A tethered football comprising:

a football;

a primary shock cord having a first predetermined length and first spring constant, said primary shock cord having two free ends, one of said two free ends adapted to be secured to a stationary object;

a differential shock device having a second predetermined spring constant greater than said first spring constant, wherein said second spring constant is selected to permit said differential shock device to begin stretching once said primary shock cord has stretched beyond its original length to a point slightly below failure of said primary cord;

means for coupling the other of said free ends of said primary shock cord to said differential shock device; and means for attaching said differential shock device to said football.

13. The tethered football as recited in claim 12, wherein said coupling means includes a swivel with two rotatable rings, said primary shock cord being secured to one of said rotatable rings while said differential shock device is secured to the other of said rotatable rings.

14. The tethered football as recited in claim 12, wherein said differential shock device at least one loop of an elastic cord.

15. The tethered football as recited in claim, wherein said attaching means includes a strap, said strap being fed through said at least one loop forming said differential shock device.

16. The tethered football as recited in claim 15, wherein said football is a regulation size football.

17. The tethered football as recited in claim 15, wherein said football is a non-regulator size football.

18. A tether for a football, the tether comprising:

a primary elastic cord having a first predetermined length and first spring constant, said primary elastic cord having two free ends, one of said two free ends adapted to be secured to a stationary object;

a secondary elastic device having a second length relatively shorter than said first length and a second spring constant different from said first spring constant;

a swivel with two rotatable rings, wherein the other of said two free ends of said primary elastic cord is adapted to be secured to one of said rotatable rings while said one or more loops of said secondary elastic device are adapted to be secured to the other of said rotatable rings;

a strap, adapted to be attached to said secondary elastic device; and a velcro strip for enabling said strap to be releasably attached to a football.

19. The tether as recited in claim 18, wherein the football is a soccer ball.

* * * * *

UNITED STATES PATENT AND TRADEMARK OFFICE

CERTIFICATE OF CORRECTION

PATENT NO. : 5,772,542

DATED : June 30, 1998

INVENTOR(S) : Larry A. Gildea

It is certified that error appears in the above-indentified patent and that said Letters Patent is hereby corrected as shown below:

Column 7, line 24, after "cord" delete "point".
Column 7, line 32, after "device" insert --includes--.
Column 7, line 49, replace "junior" with --non-regulation--.
Column 8, line 22, after "device" insert --includes--.
Column 8, line 24, after "claim" insert --14--.
Column 8, line 29, change "15" to --12--.
Column 8, line 31, change "15" to --12--.

Signed and Sealed this

Twenty-seventh Day of October, 1998

*Attest:*

Bruce Lehman

BRUCE LEHMAN

*Attesting Officer*

*Commissioner of Patents and Trademarks*